US005412412A

United States Patent [19]

Drake et al.

[11] Patent Number: 5,412,412

[45] Date of Patent: May 2, 1995

[54] INK JET PRINTHEAD HAVING COMPENSATION FOR TOPOGRAPHICAL FORMATIONS DEVELOPED DURING FABRICATION

[75] Inventors: Donald J. Drake, Rochester; Robert P. Altavela, Pittsford, both of N.Y.

[73] Assignee: Xerox Corporation, Stamford, Conn.

[21] Appl. No.: 997,473

[22] Filed: Dec. 28, 1992

[51] Int. Cl.[6] ..... B41J 2/145; B41J 2/05

[52] U.S. Cl. ..... 347/40; 347/42; 347/43

[58] Field of Search ..... 347/26, 40, 42, 43

[56] References Cited

U.S. PATENT DOCUMENTS

| | | | |
|---|---|---|---|
| Re. 32,572 | 1/1988 | Hawkins et al. | 156/626 |
| 4,463,359 | 7/1984 | Ayata et al. | 346/1.1 |
| 4,638,337 | 1/1987 | Torpey et al. | 346/140 R |
| 4,678,529 | 7/1987 | Drake et al. | 156/234 |
| 4,740,800 | 4/1988 | Kyoshima | 346/140 R |
| 4,774,530 | 9/1988 | Hawkins | 346/140 R |
| 4,899,181 | 2/1990 | Hawkins et al. | 346/140 R |

*Primary Examiner*—Benjamin R. Fuller
*Assistant Examiner*—Valerie Ann Lund

[57] ABSTRACT

An improved thermal ink jet printhead is formed by the alignment and bonding of an anisotropically etched silicon wafer channel plate, containing a plurality of channel grooves, to a silicon wafer heater plate, containing a plurality of heating and addressing elements which are covered by a patterned thick film layer. The printhead enables better bonding of the two plates by compensating for raised lips or edges formed on the outside edge of opposing last pits in an array of pits located in the thick film layer that are created while photofabricating the pits in the insulating layer. The fabrication sequence compensates for the raised edges by including a non-functional straddling channel that nullifies the standoff created by the raised edge and a corresponding additional non-functional pit that positions the raised edge away from the functional channels and nozzles.

6 Claims, 5 Drawing Sheets

INK JET PRINTHEAD HAVING COMPENSATION FOR TOPOGRAPHICAL FORMATIONS DEVELOPED DURING FABRICATION

BACKGROUND OF THE INVENTION

The present invention relates to a thermal ink jet printhead and method of manufacture therefore, and more particularly to an improved thermal ink jet printhead having minimized standoff between two bonded parts by compensating for topographic formations developed in an insulating layer during fabrication.

In existing thermal ink jet printing systems, an ink jet printhead expels ink droplets on demand by the selective application of a current pulse to a thermal energy generator, usually a resistor, located in capillary-filled, parallel ink channels a predetermined distance upstream from the channel nozzles or orifices. U.S. Pat. No. Re. 32,572 to Hawkins et. al. exemplifies such a thermal ink jet printhead and several fabricating processes therefor. Each printhead is composed of two parts aligned and bonded together. One part is a substantially flat substrate which contains on the surface thereof a linear array of heating elements and addressing elements (heater plate), and the second part is a substrate having at least one recess anisotropically etched therein to serve as an ink supply manifold when the two parts are bonded together (channel plate). A linear array of parallel grooves are also formed in the second part, so that one end of the grooves communicate with the manifold recess and the other ends are open for use as ink droplet expelling nozzles. Many printheads can be made simultaneously by producing a plurality of sets of heating element arrays with their addressing elements on a silicon wafer and by placing alignment marks thereon at predetermined locations. A corresponding plurality of sets of channel grooves and associated manifolds are produced in a second silicon wafer. In one embodiment, alignment openings are etched in the second silicon wafer at predetermined locations. The two wafers are aligned via the alignment openings and alignment marks, then bonded together and diced into many separate printheads.

Improvements to such two part thermal ink jet printheads include U.S. Pat. No. 4,638,337 to Torpey et. al. that discloses an improved printhead similar to that of Hawkins et. al., but has each of its heating elements located in a recess (termed heater pit). The recess walls containing the heating elements prevent lateral movement of the bubbles through the nozzle and therefore the sudden release of vaporized ink to the atmosphere, known as blow-out, which causes ingestion of air and interrupts the printhead operation whenever this event occurs. In this patent, a thick film organic structure such as polyimide, Riston® or Vacrel® is interposed between the heater plate and the channel plate. The purpose of this layer is to provide the recesses for the heating elements, so that the bubbles which are formed on the heating elements are laterally constrained, thus enabling an increase in the droplet velocity without the occurrence of vapor blow-out and concomitant air ingestion. U.S. Pat. No. 4,774,530 to Hawkins further refines the two part printhead by disclosing an improvement over the patent to Torpey et. al. Further recesses (termed bypass pits) are patterned in the thick film layer to provide a flow path for the ink from the manifold to the channels by enabling the ink to flow around the closed ends of the channels, thereby eliminating the fabrication steps required to open the groove closed ends to the manifold recess. The heater plates, having the aforementioned improvements of heater pits and bypass pits formed in the thick film organic structure covering the heater plate surface, are aligned with the channel plate, so that each channel groove has a recessed heating element therein.

Thorough bonding between heater and channel plates is paramount to maintaining the efficiency, consistency, and reliability of an ink jet printhead. U.S. Pat. No. 4,678,529 to Drake et. al. discloses a method of bonding ink jet printhead components together by spin coating or spraying a relatively thin, uniform layer of adhesive on a flexible substrate and then manually placing the flexible substrate surface with the adhesive layer against a printhead component surface. A uniform pressure and temperature is applied to ensure adhesive contact with all coplanar surface portions and then the flexible substrate peeled away, leaving a uniformly thin coating on the surfaces to be bonded. A roller or vacuum lamination may be applied to the flexible substrate to insure contact on all of the lands or coplanar surfaces of the printhead part. Unfortunately, this labor intensive method permits adhesive layer thickness variation between a plurality of identical parts, so that ink flow characteristics varies from printhead to printhead. Accordingly, a more mechanized process to place the adhesive coating on the disk with the channel wafer was required to minimize operator involvement and consequent variation in parameters which introduced thickness variations in the amount of adhesive layer transferred to the channel wafers, especially in the thickness variations from wafer-to-wafer. This process is described in U.S. patent application Ser. No. 07/888,220, to Narang et. al., Filed May 26, 1992. The process includes the step of applying a uniform thick layer of adhesive to one surface of a plurality of planar substrates, one substrate at a time, by a method and apparatus which controls both the adhesive layer thickness on each substrate surface and the thickness variations from substrate-to-substrate. As a result, consistent, repeatable, uniformly thick adhesive layers may be applied to each of a plurality of substrates, and the applied layers meet the same tolerance for thickness variation.

Although advances have improved the adhesive layer thickness which bonds the ink jet printhead heater and channel plates, insufficient adhesion between bonded heater and channel plates continues to cause a host of problems affecting channel firing consistency such as different drop sizes between adjacent channels. Since increased adhesive layer thickness is not a practical solution because it tends to spread or wick into the channel, the inter-channel gaps between bonded heater and channel plates must be minimized in order to insure consistent printhead firing characteristics. As taught by the above identified U.S. patents, two wafers are bonded together after alignment for subsequent dicing into individual printheads Each printhead part is formed individually on two separate substrates or wafers, where one contains heating elements and the other ink channels or passageways. The wafer containing the ink channels is silicon, and the channels are formed by an anisotropic etching process. The anisotropic or orientation dependent etching has been shown to be a high yielding process that produces very planar and highly precise channel plates. The other wafer containing the heating elements as well as heater addressing logic is covered by a thick film organic structure in which heater and bypass pits are formed using photolithography. The thick film organic structure used to protect silicon substrates is often formed with polyimide, which is also used as an interconnect material and insulator. Because of its beneficial property of being impervious to water, it is commonly considered a standard material for protecting circuitry on silicon substrates. However, one drawback with the polyimide material is its tendency to form unwanted topographical formations, such as raised edges or lips (1–3 microns high) at any photoimaged edge. When bonding both heater and channel plates together, a standoff between the two plates is caused by the raised edges, which reduces the adhesiveness of the bond between the two plates and which cause the formation of inter-channel gaps.

Polyimide topography, such as raised edges, are undesirable by-products resulting from photoimaged heater and bypass pits on heater plates. The raised edges, are polyimide topographical features that critically interfere with the proximity at which heater and channel plates are bonded together. Raised edges, however, are not the only topographical formation created from photoimaged polyimide. Other topographical formations, such as wall sags or dips, compound the negative effects of raised edges by adding to the standoff between the bonded heater and channel plates. Wall dips are slumps in the polyimide walls between polyimide photoimaged pits. The polyimide sandwiched between the two wafers or plates can form more than 2 microns of topographical variation, which does not allow the bonding adhesive, approximately 2 microns or less thick, to bridge or fill in the formation of inter-channel gaps. These inter-channel gaps can allow cross-talk between channels when drops are being ejected. As the patent '529 to Drake et. al. teaches, care must be taken when applying adhesive in bonding the channel and heater plates so as to insure all fluid surfaces in contact with ink are free of adhesive in order that they are not obstructed during operation. There exists, therefore, a need to improve the adhesion between the bonded heater and channel plates in order to minimize inter-channel gaps by reducing the standoff between the butted plates without increasing the amount of adhesive or epoxy used in bonding them.

SUMMARY OF THE INVENTION

It is object of the invention to minimize the standoff between bonded heater and channel plates of a printhead, with minimal impact to the existing fabrication sequence of the printhead.

It is another object of the invention to provide a more reliable printhead that minimizes the effects of topographic formations in the thick film insulating layer that induce inter-channel gaps which degrade the reliability and performance of the printhead.

To achieve the foregoing and other objects, and to overcome the shortcomings discussed above, improvements to an ink jet printhead assembly are provided that eliminate the standoff between plates of printheads of the type formed by the alignment and bonding of an anisotropically etched silicon wafer channel plate, containing an array of channel grooves, to a patterned thick film insulating layer formed on a surface of a silicon wafer heater plate, containing an array of heating and addressing elements. The heating elements are disposed in pits formed in the thick film insulating layer. The plate standoff is caused by topographic formations introduced while forming some of the photoimaged recesses in the thick film insulating layer. The present invention introduces elements into the fabrication sequence of the printhead that compensate for the topographic formations.

In an array of pits formed using a photopatternable insulating layer, such as polyimide, distinct formations exist in certain locations which produce the standoff between the heater and channel plates of the ink jet printhead. It has been determined that a polyimide topographic formation, such as, for example, a pronounced raised edge or lip is formed only at the outside edge of the last pit in an array of pits because of the increased mass of polyimide between sets of pits. In the preferred embodiment, an additional non-functional clearance channel is formed on opposite sides of the array of channels, along with a corresponding additional, offset pit to position the raised edge formation into the clearance channel. The improved printhead eliminates standoff between the channel and heater plate caused by the raised edge thereby substantially eliminating the inter-channel gaps which cause inconsistent adhesive bonding and degraded printhead performance. The printhead fabrication is accordingly modified to include an edge straddling clearance channel that prevents the standoff created by the raised edge. A corresponding additional offset pit optionally positions the raised edge of the straddling clearance channel further from the functional channels.

A more complete understanding of the present invention can be obtained by considering the following detailed description in conjunction with the accompanying drawings, wherein like index numerals indicate like parts.

DESCRIPTION OF THE PREFERRED EMBODIMENT

Figure 1:
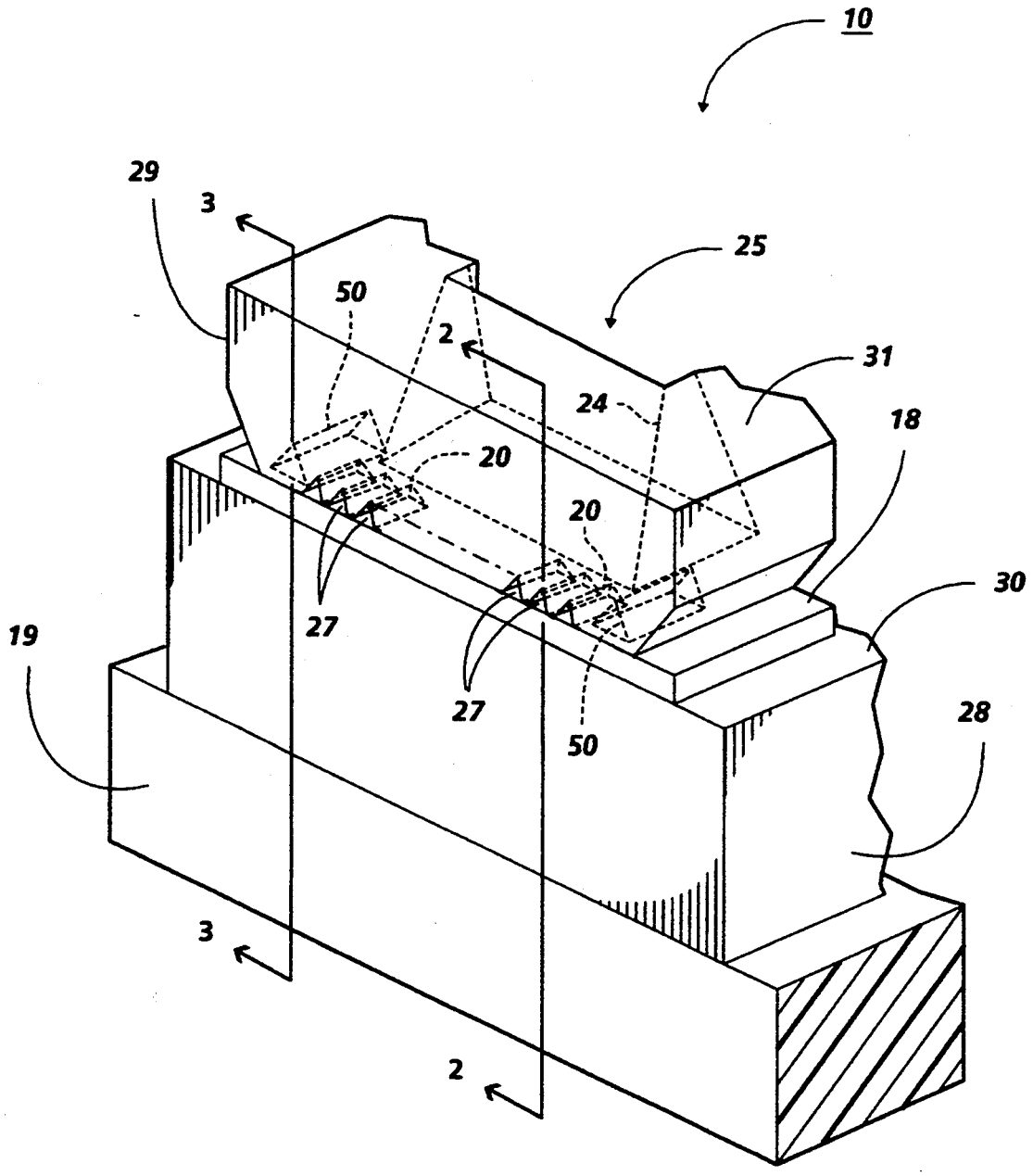
FIG. 1 is an enlarged isometric view of a printhead incorporating the present invention.
Figure 2:
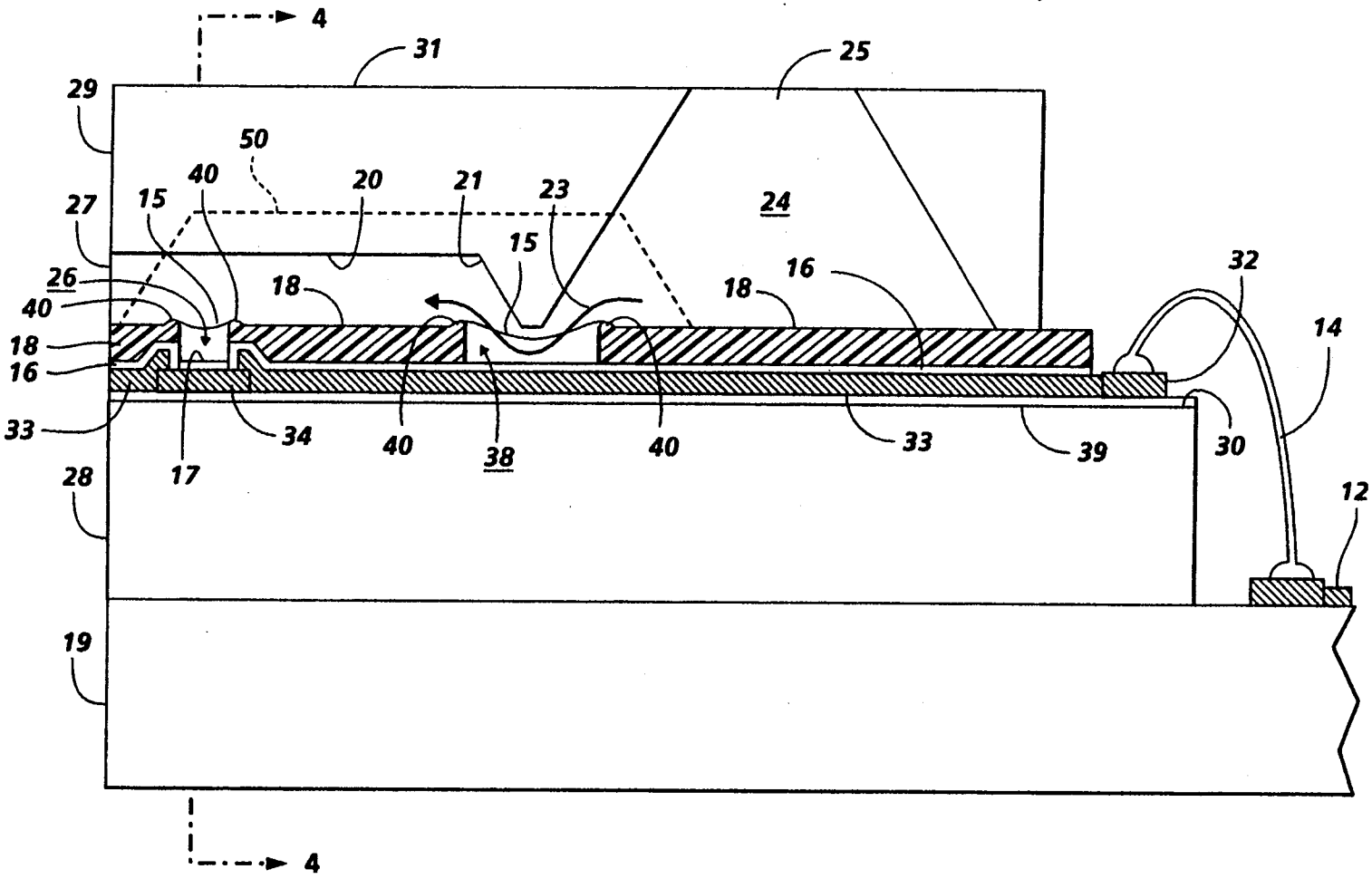
FIG. 2 is an enlarged cross-sectional view of FIG. 1 as viewed along the line 2—2 thereof.

In FIG. 1, an enlarged, schematic isometric view of the printhead 10 incorporating the present invention is depicted, showing the front face 29 thereof containing the array of droplet emitting nozzles 27 and outer, non-functional channels 50 shown in dashed line. Cross sectional views of FIG. 1 are taken along view line 2—2 through one active channel 20 and along view line 3—3 through one non-functional, outer channel 50. FIG. 2 shows how ink flows from the manifold 24 and around the end 21 of the groove or ink channel 20, as depicted by arrow 23. In FIGS. 1 and 2, the lower electrically insulating substrate or heating element plate 28 has the heating elements or resistors 34 and addressing elements 33 produced monolithically on underglaze insulating layer 39 formed on surface 30 thereof, while the upper substrate or channel plate 31 has parallel grooves 20 which extend in one direction and penetrate through the channel plate front face 29. On the opposing sides of the array of grooves 20 is a similar larger groove 50, discussed later, which does not penetrate the front face. The end of grooves 20 opposite the nozzles terminate at slanted wall 21. The through recess 24 is used as the ink supply manifold for the capillary filled ink channels 20 and has an open bottom 25 for use as an ink fill hole. The surface of the channel plate with the grooves are aligned and bonded to the heater plate 28, so that a respective one of the plurality of heating elements 34 is positioned in each channel 20, formed by the grooves and the lower substrate or heater plate. Ink under a slight negative pressure enters the manifold formed by the recess 24 and the lower substrate 28 through the fill hole 25 and, by capillary action, fills the channels 20 by flowing through a plurality of elongated recesses 38 formed in the thick film insulating layer 18, one for each channel 20. Non-functional channel 50 also has an elongated recess 38, but it does not enable communication with the ink manifold 24. The ink at each nozzle forms a meniscus, the combination of negative ink pressure and surface tension of the meniscus prevents the ink from weeping therefrom.

As disclosed in U.S. Pat. No. Re. 32,572 to Hawkins et. al. and U.S. Pat. No. 4,774,530 to Hawkins, both incorporated herein by reference, thermal ink jet die or printheads 10 are generated in batches by aligning and adhesively bonding an anisotropically etched channel wafer (not shown) to a heater wafer (not shown) followed by a dicing step to separate the bonded wafers into individual printheads 10. Prior to forming the arrays of heating elements and addressing electrodes on surface 30 of the heater wafer, an underglaze layer 39 is formed thereon, such as, silicon dioxide or silicon nitride. After the arrays of heating elements and addressing electrodes have been formed, a thin film passivation layer 16 is deposited on the heater wafer surface 30 and over the heating elements and addressing elements. Layer 16 provides an ion barrier which will protect exposed electrodes from the ink. The thick film insulating layer 18 of photopatternable material, such as, for example, polyimide, is deposited over the passivation layer 16 and is patterned to expose the heating elements, thereby placing the heating elements in separate pits 26, to remove the thick film from the electrode terminals 32, and to remove the thick film layer at locations which will subsequently provide ink flow bypass recesses 38 between the reservoir 24 and the ink channels 20. The heating elements are covered by protective layer 17, such as tantalum, to prevent cavitational damage to the heating elements caused by the collapsing vapor bubbles. The printheads are mounted on daughterboards 19 and electrically connected to electrodes 12 thereon by wire bonds 14. The daughterboard provides the interface with the printer controller (not shown) and power supplies (not shown).

Figure 3:
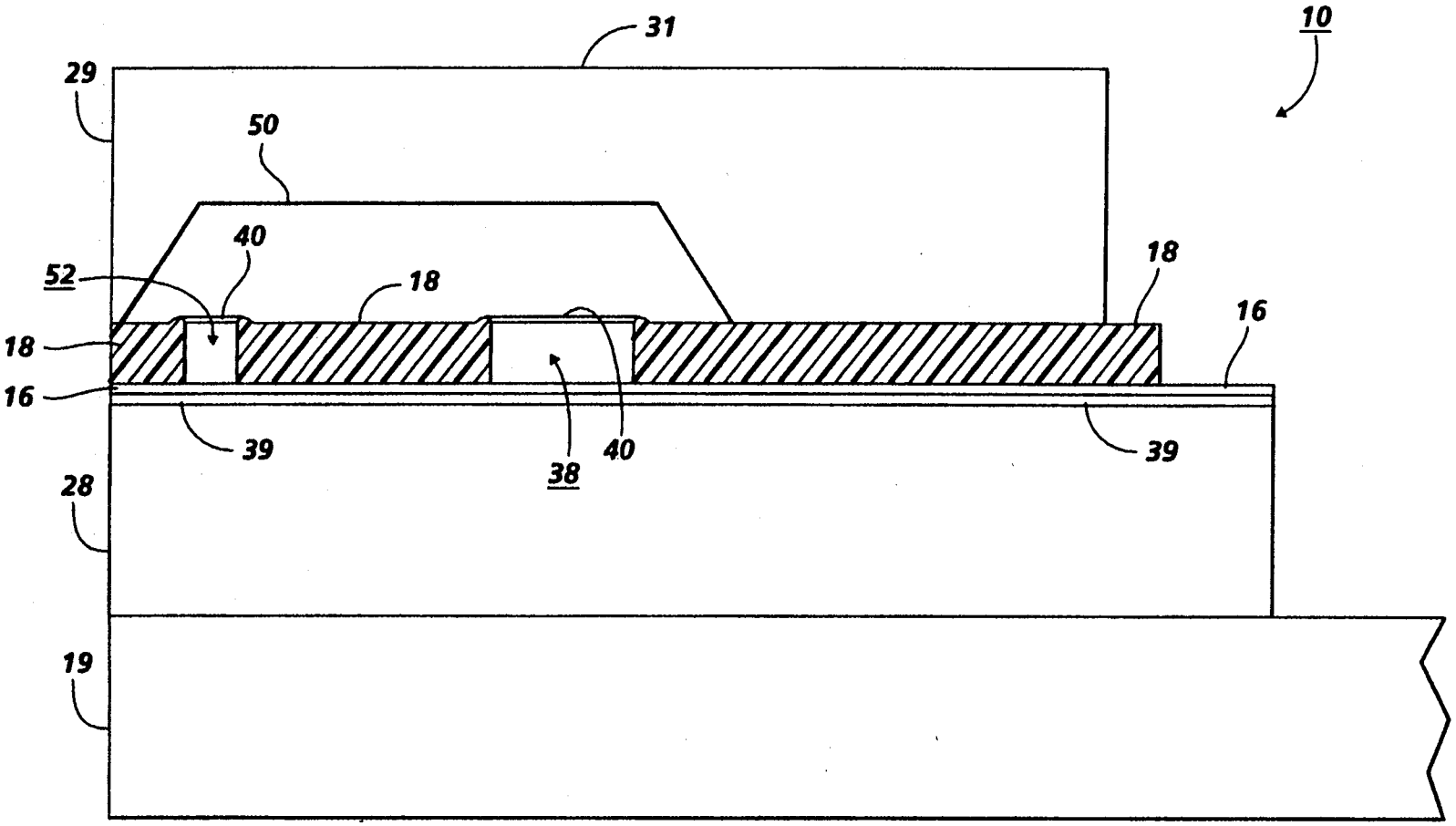
FIG. 3 is an enlarged cross-sectional view of FIG. 1 as viewed along viewline 3—3 thereof.

FIG. 3 shows a cross-sectional view of the non-functional channel 50 and shows that this channel contains a pit 52 without a heating element and an elongated recess 38 that does not provide connection to the ink manifold 24. Also, shown in FIG. 3 is the lips or protrusions 40 formed by the patterning process for the thick film layer 18, which in the preferred embodiment is polyimide. The unexpected formation of polyimide lips was found when the prior art printheads formed by the bonding of channel plates to heater plates were found to be deficient. Investigation led to the discovery of various topographic formations that prevented adequate bonding. When the spacing between the patterned recesses in thick film polyimide layers was a small dimension, the polyimide material between the recesses sagged slightly. The pits 26 and bypass recesses 38 shown in FIG. 2 are closely spaced at 300 per linear inch or more and, therefore, the material 15 between the pits sunk or sagged slightly. This sagging increases the severity of the problem of lip formation because of its accumulative affect on the standoff between the channel and heaters wafers, while the uniform layer of adhesive deposited on the channel wafer surface having the plurality of sets of channel grooves 20 and through recesses 24 must be relatively thin, as disclosed in U.S. Pat. No. 4,678,529 to Drake et. al. The thicker the adhesive layer, the more likely that the adhesive will flow into the channels and impact printhead performance, so that a relatively thin layer of adhesive is important. The topographic formation of lips at the edges of patterned recesses in polyimide and other thick film materials occurs when the spacing between patterned recesses are relatively large. Thus, the upstream and downstream ends of the pits and bypass recesses have a formation of lips 40, because of the relatively large spacing between the set of heating element arrays on the heater wafer, but do not impact the gap or standoff between the channel and heater plates because the channel grooves 20 and through recess 24 straddle these lips. The polyimide lips 40 formed along the outer sides which are parallel to the channels and cause the channel plate and heater plate to be separated by a gap 42 in prior art printheads, as shown in FIG. 5. FIG. 5 is a cross-sectional view through the heating elements 34 and pits 26 of a prior art printhead and is a view similar to that of FIG. 4, discussed below.

Figure 4:
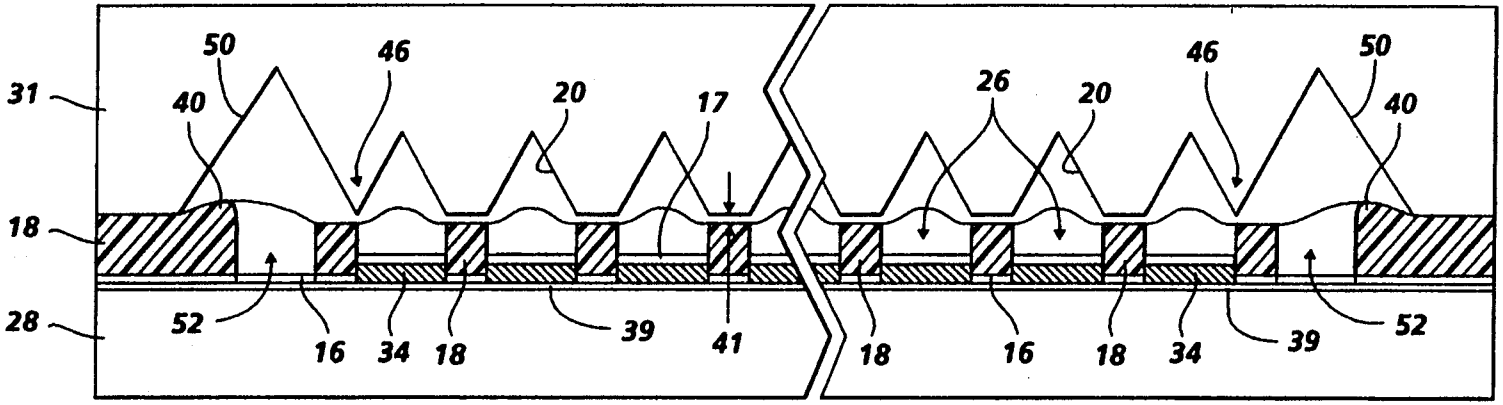
FIG. 4 is an enlarged cross-sectional view of FIG. 2 as viewed along the line 4—4 and shows the outer opposing non-functional ink jet channels and corresponding non-functional pits to eliminate the undesired channel and heater plate separation.
Figure 5:
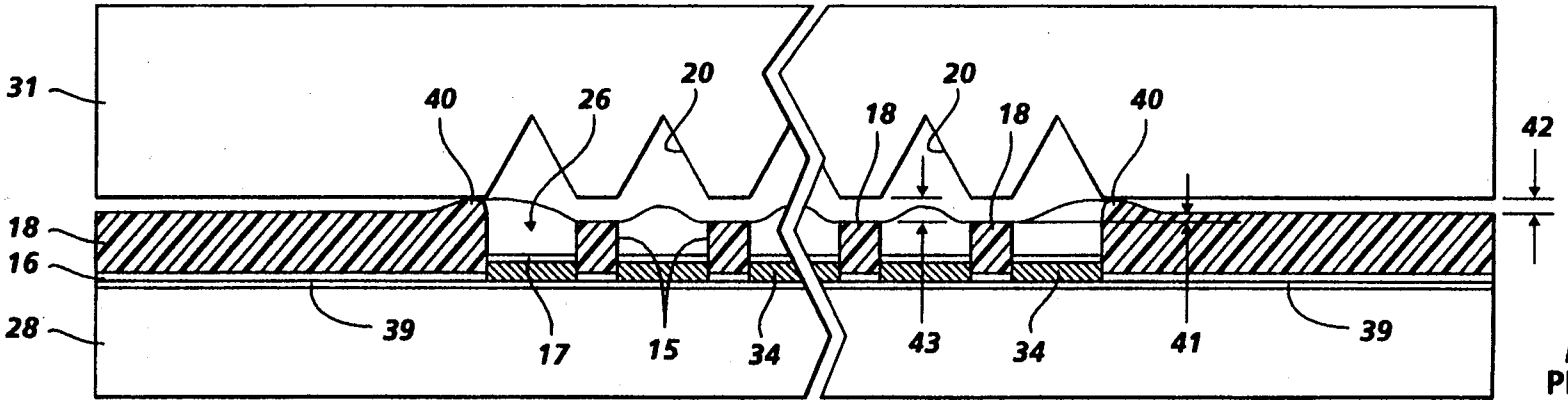
FIG. 5 PRIOR ART
FIG. 5 is an enlarged cross-sectional view of a typical prior art ink jet printhead similar to FIG. 4 and showing the standoff between the heater and channel plates caused by topographical formations developed during fabrication.

FIG. 4 is an enlarged cross sectional view taken along view line 4—4 of FIG. 2 through the array of heating elements 34 and pits 26. The ink channels 20 formed in channel plate 31 are mated with a corresponding heating element plate 28 with heating elements 34 recessed in heater pits 26. The pits 26 are separated by pit walls 15 of thick film material (polyimide) which space the pits from each other. FIG. 5 is a cross-sectional view of a prior art printhead similar to FIG. 4, and exemplifies two topographic formations which result when heater pits 26 and walls 15 are formed in thick film insulating layer 18 using, for example, polyimide. The thick film layer is photolithographically processed to enable patterning of and removal of those portions of the layer covering the heating elements 34 to form recesses 26, as disclosed in U.S. Pat. No. 4,638,337, to Torpey et. al., the pertinent portions of which are herein incorporated by reference. Bypass recesses 38 are also patterned and removed from the thick film insulating layer 18 as taught by U.S. Pat. Nos. 4,774,530 to Hawkins and also incorporated herein by reference. FIG. 5 is also representative of a cross-sectional view through the array of bypass recesses 38 because each channel has its own bypass recess 38 which has the same width as the pits 26. Thus, the bypass recesses are concurrently formed with the pits and formed in a similar manner, the only difference being the length of the bypass recess. As with heater pits 26, bypass recesses 38 are also separated by walls 15 and have corresponding topographic formations. Bypass recesses and heater pits will be hereinforth described solely in terms of heater pits 26 for simplicity, however, it should be understood that although they inherit similar qualities, they each perform distinct functions.

Referring to FIG. 5, topographic formations, as indicated above, are formed when heater pits 26 are photolithographically processed in thick film insulating layer 18. These formations on the outer opposing pits in the array have the negative quality of increasing the standoff between channel plate 31 and heater plate 28. A first topographic formation is raised edge or lip 40 which attributes to heater and channel plate standoff as indicated by spacing 42. Raised edge 40 is formed in polyimide thick film layer 18, and is not only formed on the sides of the array of pits, but in the front and back of the pits as well (see FIG. 2). The plate standoff caused by the lips formed to the front and back of the pits has negligible affects because the channels 20 and manifolds 24 straddle them. A second topographic formation is a sag or dip in wall 15 between the pits as indicated by spacing 41. The combination of the two resulting topographical formations cause a spacing or gap 43 equal to both the spacings 41 and 42 in the vicinity of walls 15, the separation between pits and bypass recesses. This large gap 43 is responsible for promoting interchannel cross talk or ink flow between channels that undermines the operational consistency of printhead 10.

With respect to the preferred embodiment of the present invention, the gaps 41 in FIG. 4 are only formed by the sag in walls 15 as opposed to the gaps 43 in the prior art printhead of FIG. 5 which is the combination of both the wall 15 sag and raised lip 40 (gap 42). Accordingly, this gap 41 of FIG. 4 can be readily sealed by the adhesive (not shown) on channel plate surface having the grooves 20. The raised edge 40 formed in polyimide insulating layer 18 is compensated for in the fabrication sequence of the printhead 10. The fabrication sequence is first modified by adding a non-functional, lip clearance channel 50 to both ends of the array of channels in channel plate 31. Lip clearance channel 50 is enlarged in order that raised edge 40 is straddled, and thereby minimizing, if not eliminating, the plate standoff resulting in spacing 42. The non-functional channel grooves 50 are set back further from the front face, so that the dicing cut forming the printhead front face and concurrently opening the grooves 20 to form nozzles 27 does not open the non-functional groove 50. Also, the non-functional groove is longer than the grooves 20, so that the raised lip 40 of the outer bypass recess 38 is straddled thereby (see FIG. 3). Fabrication of printhead channel plates by anisotropically etching silicon wafers is well known and taught by U.S. Pat. No. 4,774,530 to Hawkins which is herein incorporated by reference. Accordingly, the fabrication sequence of channel plate 31 is modified to include the formation of non-functional channel grooves 50 at either end of the array of channel grooves 20, through concurrent orientation dependent etching techniques.

The heater plate 28, however, must be modified as well in order to position the polyimide raised lip 40 beyond the functional pits 26 containing heating elements 34, so that it can be straddled by non-functional channel 50. The modification of the heater plate fabrication sequence is limited to patterning the thick film insulating layer 18 to provide an extra pit 52 on the opposite ends of the array of functional pits 26. The polyimide layer 18, therefore, is modified so that, when patterning and forming the heater pits and bypass recesses, the outer non-functional pits 52 contain the raised lip 40; thus, eliminating the raised lips from heater pits having heater elements 34. In an alternate preferred embodiment, a second, non-functional heater pit (not shown) is added between the non-functional pit 50 with the raised lip 40 and the end of the array of heater elements, in order to minimize the possibility of interchannel cross talk that may result from narrowed face 46, caused by the increased size of the straddling, non-functional channel 50, which has the same center-to-center spacing as the channels 20. The addition of another non-functional heater pit requires the addition of another bypass recess (not shown) which, of course, is not in communication with the manifold 24. If a second, non-functional heater pit (i.e., a pit without a heating element) is added on each end of the array of functional pits, then an additional non-function channel groove (not shown) must be added between the outermost channels 20 and the non-functional channel 50. This additional non-functional channel must be the same size as the functional channel grooves 20. Because the non-functional bypass recesses do not communicate with the ink manifold 24, no ink enters the non-functional channels 50 and they remain dry. Thus, pits 52 are formed at the opposing ends of the array of channels 20 to position raised lip 40 in the lip straddling non-functional channel 50, and the additional non-functional pits and non-functional channels of the alternate embodiment (not shown) offset effects that may result due to narrowed face 46.

Figure 6:
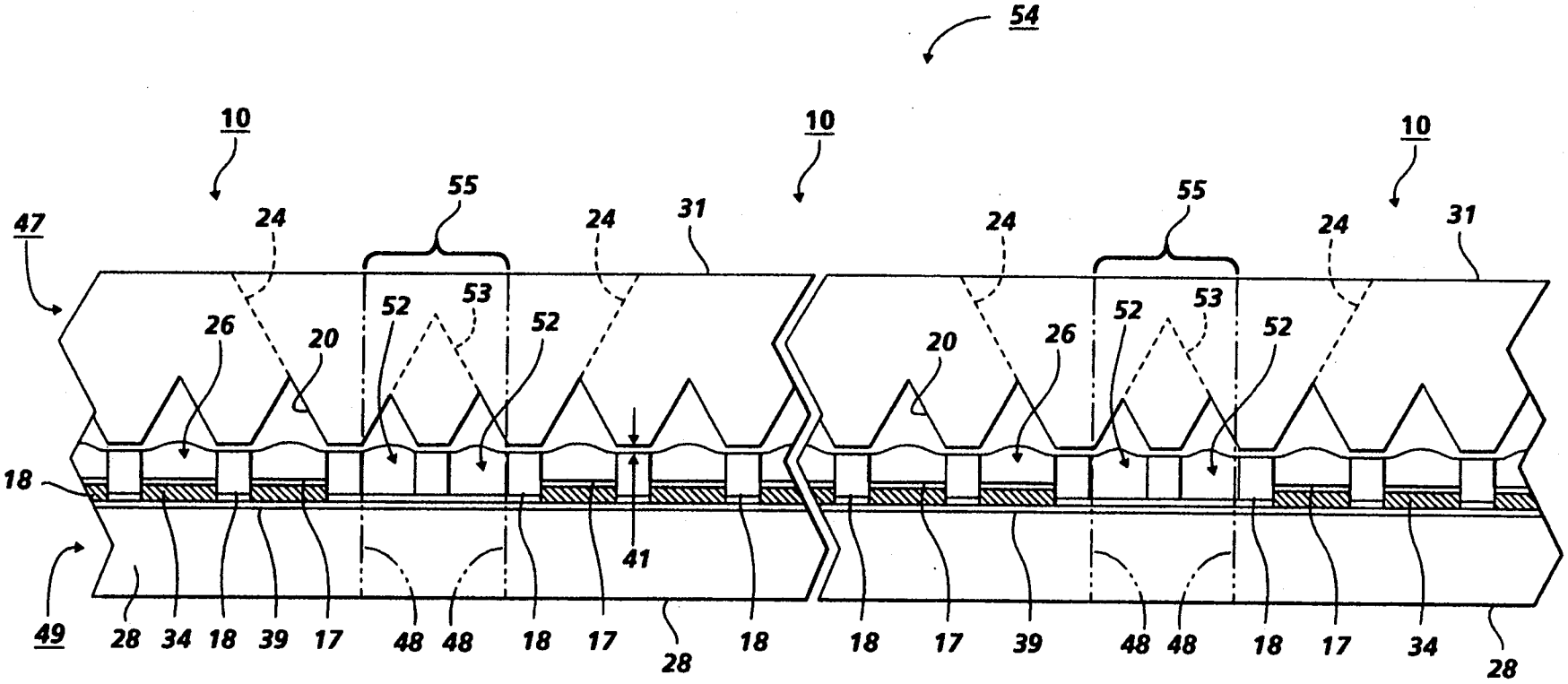
FIG. 6 is an enlarged cross-sectional view similar to FIG. 4, showing an alternate embodiment of the present invention.

An alternate embodiment is shown in FIG. 6, a cross-sectional view of a wafer pair 54, as viewed across the array of heating elements 34. In this embodiment, the spacing between the functional pits 26 and non-functional pits 52, as well as the functional and non-functional bypass recesses (not shown) are maintained uniformly spaced across an entire wafer 49. Individual printheads 10 are separated from the wafer pair 54 by die cuts 48. The wafer pair material 55 between the printheads 10 is discarded. In this alternate embodiment, to prevent standoff by the front and back lips 40, as better seen in FIG. 2, identical channel grooves 20 are formed uniformly across the surface of wafer 47. In this way, there is no raised lip on the sides of the pits and bypass recesses, because the relatively small separation by walls 15 between pits and bypass recesses eliminates this topographic formation. Thus, only the front and back lips 40 are formed and each of these are straddled by a channel or non-functional manifold recess 53 (shown in dashed line), which may not be a through etched recess. Thus adding pits 52 without heater elements 34 to those with heating elements across the length of the wafer 49, eliminates lip 40 on the sides of the pits and bypass recesses. This alternate embodiment also requires that the channel wafer 47 be modified to provide for nonfunctional but equally sized and spaced channels across the entire channel wafer 47. In addition, non-functional manifold recesses 53 for the nonfunctional channels are required, so that the front and back lips 40 on the bypass recesses (not shown) are straddled thereby in order to eliminate the standoff 42 between the wafer pair.

In summary, the two embodiments of the invention offset the negative effects of the raised polyimide lip 40, which is undesirably formed photolithographically in the thick film polyimide insulating layer 18. The affects of the lip are offset without undue modification to the fabrication sequence of a printhead comprising both a heater and channel plate. By minimizing the heater and channel plate standoff, heater and channel plate bonding adhesive achieves a stronger inter-plate bond. Since polyimide plate standoff due to topographical lip formations has been minimized, other polyimide standoff created by wall dips or sags become less significant since adhesive bonding strength has been improved resulting from the minimized plate standoff. The minimized standoff also has the advantage of obviating the application of excess adhesive that may run into and clog ink flow channels. The application of insufficient adhesive avoids clogging ink flow channels, but may induce interchannel crosstalk or ink leakage from the printhead.

The invention has been described with reference to the preferred embodiments thereof, which are illustrative and not limiting. Various changes may be made without departing from the spirit and scope of the invention as defined in the appended claims.

We claim:

1. An improved ink jet printhead of the type having a silicon upper substrate which has one surface that is anisotropically etched to form a set of parallel grooves and an ink supply manifold therein, the set of parallel grooves being used as a linear array of ink channels for providing communication between the ink supply manifold and a set of droplet ejecting nozzles in said printhead, and further having a lower substrate which has one surface that has an array of heating elements and addressing electrodes formed thereon, the upper and lower substrates being aligned, mated, and bonded together to form the printhead with a thick film insulating layer sandwiched therebetween, the thick film insulating layer having been deposited on the surface of the lower substrate having the array of heating elements and addressing electrodes thereon and patterned to form recesses therethrough prior to alignment, mating and bonding of the upper and lower substrates, the recesses forming arrays of heater pits and channel bypass recesses to correspond in number and to align with the set of parallel grooves and array of heating elements, so that each heating element resides in a heater pit and each groove of said set of parallel grooves has a heating element in a heater pit therein and has a bypass recess interconnecting the groove with the ink supply manifold to provide communication therebetween, the patterning of the heater pits and bypass recesses in the thick film insulating layer producing topographic formations, some of which cause standoff of the upper substrate, wherein the improvement comprises:

the thick film insulating layer having defined therein at least one additional nonfunctional heater pit and one additional nonfunctional bypass recess on opposite sides of the arrays of heater pits and bypass recesses, respectively, said additional nonfunctional heater pits and bypass recesses relocating the topographical formations in the thick film insulating layer which would cause standoff of the upper substrate away from the array of heater pits and bypass recesses to the additional nonfunctional heater pits and bypass recesses which have no other function; and the upper silicon substrate having formed therein at least one additional, nonfunctional, parallel groove on opposite sides of the set of parallel grooves, said additional nonfunctional grooves straddling the topographical formations formed proximate to said additional nonfunctional heater pits and bypass recesses formed in the thick film insulating layer on the lower substrate which would have caused the upper substrate to standoff, so that a standoff between the upper and lower substrates caused by said topographical formations in the thick film insulating layer is prevented., because the topographical formations which would cause the standoff is located in the additional nonfunctional grooves which have no other function.

2. The printhead of claim 1, wherein the additional nonfunctional grooves are larger and longer than the set of parallel grooves used as ink channels, wherein the additional nonfunctional grooves have closed opposite ends, and wherein the additional nonfunctional grooves are isolated from the ink supply manifold.

3. The printhead of claim 2, wherein the thick film insulating layer is polyimide.

4. The printhead of claim 2, wherein said additional grooves, said additional heater pits, and said additional bypass recesses are each spaced, respectively, from the array of parallel grooves which serve as ink channels, the array of heater pits with heating elements therein, and the array of bypass recesses which interconnect the ink supply manifold with the array of parallel grooves, by a second additional groove, a second additional heater pit, and a second bypass recess; and wherein said second additional groove, said second additional heater pit, and said second bypass recess are each respectively essentially of the same size as the grooves in said array of parallel grooves, the heater pits in said array of heater pits, and the bypass recesses in said array of bypass recesses, so that the topographical formations which cause the standoff are spaced from the ink channels, heating elements, and the ink communicating bypass recesses by the second additional grooves, heater pits, and bypass recesses.

5. An ink jet printhead, comprising:

a silicon upper substrate having in one surface thereof a plurality of etched parallel grooves with opposing ends and an etched ink supply manifold, the plurality of grooves including a set of grooves to serve as ink channels and at least one additional groove with opposing closed ends on each side of the set of grooves, one end of each groove in said set of grooves being open to serve as a droplet-ejecting nozzles and the other end of said set of grooves being closed, the manifold being adjacent but spaced from the groove closed ends of said set of grooves;

a lower substrate having on one surface thereof an array of heating elements and addressing electrodes;

a thick film insulating layer deposited on the lower substrate surface having the heating elements and addressing electrodes and being patterned to form recesses therethrough, the recesses including an array of heater pits which expose the heating elements, an array of bypass pits having a predetermined location, and an additional pit on each side of each array of heater pits and bypass pits and adjacent thereto, the additional pits each being similarly sized as that of the heater pit or bypass pit to which the additional pit is closer, the patterning of the recesses producing topographical formations proximate to the additional pits; and the upper substrate surface having the etched grooves and manifold being aligned and bonded to the thick film insulating layer to produce the printhead, the aligning and bonding of the upper substrate to the thick film insulating layer providing that each groove in said set of grooves has a heating element in a heater pit, and a bypass pit located between the manifold and groove closed ends for ink communication therebetween, the open ends of the grooves in said set of grooves serving as droplet-ejecting nozzles, while the additional grooves straddles and covers the additional pits and the topographical formations proximate thereto, thereby preventing the standoff of the upper substrate from the thick film insulating layer.

6. The printhead of claim 5, wherein the additional grooves are larger and longer than the grooves in said set of grooves which serve as ink channels and are isolated from the ink supply manifold.

* * * * *